US006415855B2

(12) United States Patent
Gerard et al.

(10) Patent No.: US 6,415,855 B2
(45) Date of Patent: Jul. 9, 2002

(54) CORRUGATED FIN WITH PARTIAL OFFSET FOR A PLATE-TYPE HEAT EXCHANGER AND CORRESPONDING PLATE-TYPE HEAT EXCHANGER

(75) Inventors: Claude Gerard, Chantraine; Claire Szulman, Paris; Fabienne Chatel, Vanves; Jean-Yves Thonnelier, Voisins-le-Bretonneux; Etienne Werlen, Versailles, all of (FR)

(73) Assignee: Nordon Cryogenie SNC, Golbey (FR)

( * ) Notice: Subject to any disclaimer, the term of this patent is extended or adjusted under 35 U.S.C. 154(b) by 0 days.

(21) Appl. No.: 09/835,409

(22) Filed: Apr. 17, 2001

(30) Foreign Application Priority Data

Apr. 17, 2000 (FR) ..... 00 04942

(51) Int. Cl.[7] ..... F28F 3/00

(52) U.S. Cl. ..... 165/166; 165/146; 165/152

(58) Field of Search ..... 165/151, 152, 165/146, 166, 170, 167, DIG. 356, DIG. 360, DIG. 364, DIG. 368, DIG. 378, DIG. 391, DIG. 393

(56) References Cited

U.S. PATENT DOCUMENTS 3,282,334 A * 11/1966 Stahlheber ..... 165/166
3,380,517 A * 4/1968 Butt ..... 165/166
3,521,707 A * 7/1970 Brown ..... 165/151
3,542,124 A * 11/1970 Manfredo ..... 165/167
3,860,065 A * 1/1975 Schauls ..... 165/167
3,992,168 A 11/1976 Toyama et al.
4,282,927 A * 8/1981 Simmons ..... 165/166
4,804,041 A * 2/1989 Hasegawa et al. ..... 165/166
4,815,532 A * 3/1989 Sasaki et al. ..... 165/152
4,869,316 A * 9/1989 Yoshida et al. ..... 165/170
5,816,320 A * 10/1998 Arnold et al. ..... 165/152
6,247,527 B1 * 6/2001 Paulman ..... 165/152

FOREIGN PATENT DOCUMENTS

DE 1 809 822 11/1969
JP 61-295494 12/1986

* cited by examiner

*Primary Examiner*—Henry Bennett
*Assistant Examiner*—Terrell McKinnon
(74) *Attorney, Agent, or Firm*—Young & Thompson

(57) ABSTRACT

In this corrugated fin, each corrugation leg (10A, 10B) has a notch (18A, 18B) on at least one edge (11A) and over at least part of its height.

Application to brazed-plate heat exchangers.

10 Claims, 7 Drawing Sheets

CORRUGATED FIN WITH PARTIAL OFFSET FOR A PLATE-TYPE HEAT EXCHANGER AND CORRESPONDING PLATE-TYPE HEAT EXCHANGER

The present invention relates to a corrugated fin with partial offset for a plate-type heat exchanger, of the type defining a main overall direction of corrugation and comprising a number of adjacent rows of corrugations, each row being more or less transverse with respect to the said main overall direction and being offset, in its own longitudinal direction, with respect to the two adjacent rows, each row of corrugations comprising a set of corrugation legs connected alternately by a corrugation crest and a corrugation trough.

Corrugated fins of this type, generally known as "serrated corrugations", are widely used in brazed-plate heat exchangers, which have the advantage of offering a large heat-exchange area in a relatively small volume, and of being easy to manufacture. In these exchangers, fluid flows may be cocurrent, countercurrent or cross-flow.

FIG. 1 of the appended drawings depicts, in perspective and with partial cutaways, one example of such a heat exchanger, of a conventional structure, to which the invention applies. This may, in particular, be a cryogenic heat exchanger.

The heat exchanger 1 depicted consists of a stack of parallel rectangular plates 2, all identical, which between them define a number of passages for fluids to be placed in an indirect heat-exchange relationship. In the example depicted, these passages are, successively and cyclically, passages 3 for a first fluid, 4 for a second fluid and 5 for a third fluid.

Each passage 3 to 5 is bordered by closure bars 6 which delimit it, leaving inlet/outlet openings 7 free for the corresponding fluid. Placed in each passage are corrugated spacer pieces or corrugated fins 8 which act simultaneously as heat-exchange fins and as spacer pieces between the plates, particularly during the brazing operation, and to avoid any deformation of the plates when pressurized fluids are used, and serve to guide the flow of fluids.

The stack of plates, closure bars and corrugated spacer pieces is generally made of aluminium or aluminium alloy and is assembled in a single operation by furnace brazing.

Fluid inlet/outlet boxes 9, of semicylindrical overall shape, are then welded onto the exchanger body thus produced, to cap the corresponding rows of inlet/outlet openings, and are connected to pipes 109 for conveying and removing the fluids.

There are various types of corrugated spacer pieces 8 in existence. The conventional corrugated spacer piece known as the "serrated corrugation" is depicted in FIG. 2.

This serrated corrugation has a main overall direction of corrugation D1 and comprises a great many rows of adjacent corrugations 9, all identical 9A, 9B, 9C etc., oriented in a direction D2 perpendicular to the direction D1.

For the convenience of the description, it will be assumed that, as depicted in FIG. 2, the directions D1 and D2 are horizontal.

Each row of corrugations 3 has a crinkled shape and comprises a great many rectangular corrugation legs 10, each contained in a vertical plane at right angles to the direction D2. With respect to an overall direction F of flow of the fluid in the direction D1 in the passage in question, each leg has a leading edge 11 and a trailing edge 12. The legs are connected alternately along their upper edge by flat and horizontal rectangular corrugation crests 13 and along their lower edge by corrugation troughs 14 which are also rectangular, flat and horizontal.

The rows 9 are offset from one another in the direction D2, in one direction and the other alternately. By terming distance p separating two successive legs 10 as the "pitch" (neglecting the thickness e of the thin-sheet material of which the corrugation is made), the offset is p/2.

Thus, each row 9 is connected to the next row 9 by the crests 13, in sections of straight line 15 measuring p/2, and by the troughs 14, in sections of straight line 16 with the same lenght p/2. The planes of offsetting are the vertical planes $P_{AB}$, $P_{BC}$, etc., and the planes of offsetting when viewed from above are denoted by 17.

Incidentally, the length of each row 9 in the direction D1 is denoted l, this length being termed the "serration length", and the height of the corrugation is denoted h.

In practice, the shapes of the various parts of the corrugations may differ somewhat from the theoretical shapes described hereinabove, particularly as regards the flatness of the facets 10, 13 and 14, the verticality and the rectangular shape of these facets.

FIGS. 3 to 5 of the appended drawings are schematic cross sections taken, respectively, on the vertical plane III—III of FIG. 2, approximately on an offsetting plane P and on the horizontal mid-plane Q of the corrugation. These views illustrate the disadvantage of conventional serrated corrugations.

What happens is that a given stream of fluid flowing in the overall direction D1 has available to it, within a row 9, for example 9A, a wide passage cross section (FIG. 3), but this cross section is reduced in each plane P because of the presence of the legs 10 from the next row 9, in this instance the legs 10B of the row 9B.

Thus, the characteristic offsetting of the serrated corrugations introduces a substantial pressure drop. In order to limit this effect, relatively long serration lengths l need to be adopted, although these are not optimum from the thermal efficiency standpoint.

The object of the present invention is to reduce or even to eliminate the pressure drops induced in the serrated corrugations by the offset from one row to the next.

To this end, a subject of the invention is a corrugated fin with partial offset of the aforementioned type, characterized in that at least some corrugation legs have a notch on at least one edge and over at least part of their height.

Another subject of the invention is a plate-type heat exchanger comprising corrugated fins as defined above. This exchanger, of the type comprising a stack of parallel plates which define a number of passages of flat overall shape for the circulation of fluids, closure bars which delimit these passages, and corrugated fins arranged in the passages, is characterized in that at least some of the corrugated fins are according to the definition provided above.

Some exemplary embodiments of the invention will now be described with reference to FIGS. 6 to 17 of the appended drawings, in which.

Figure 1:
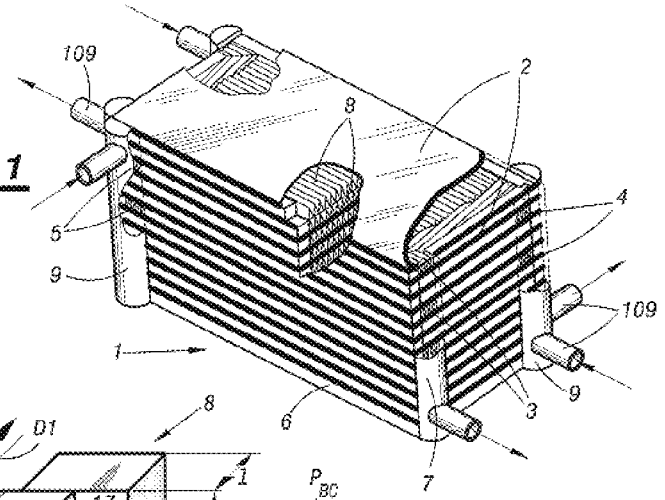
Figure 2:
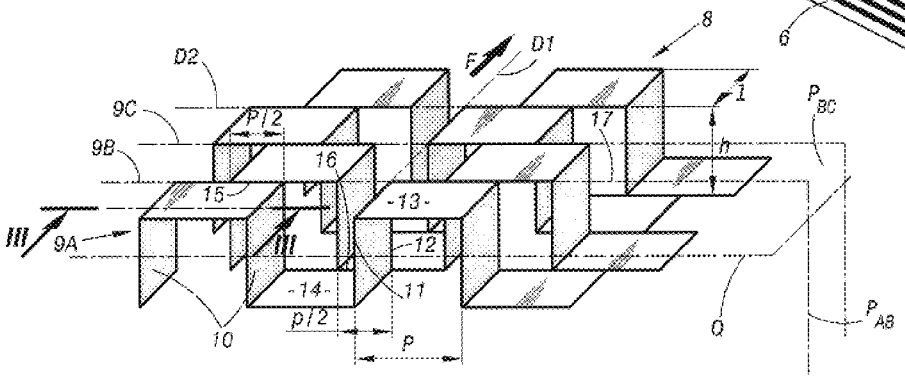
Figure 5:
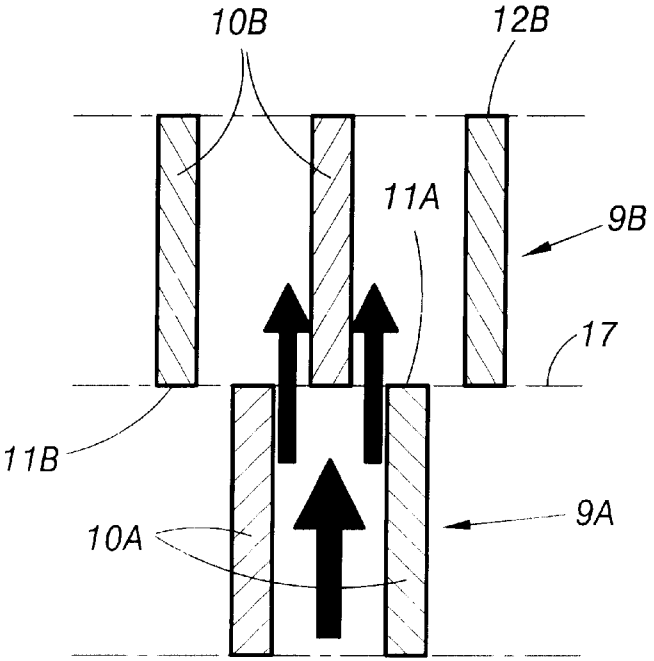
Figure 3:
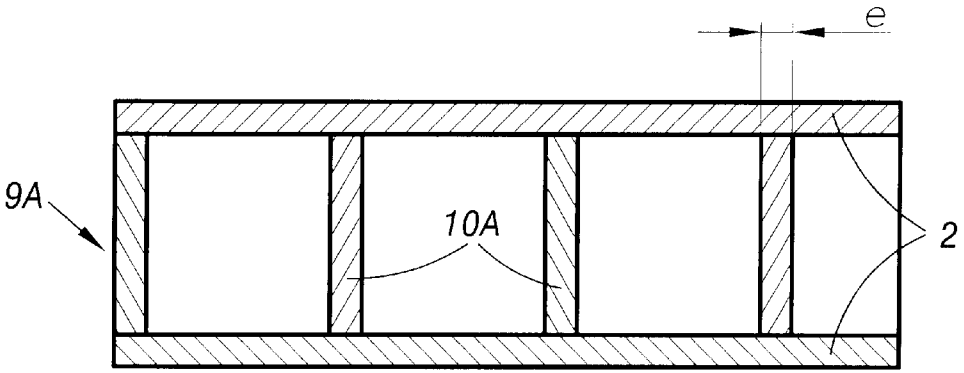
Figure 4:
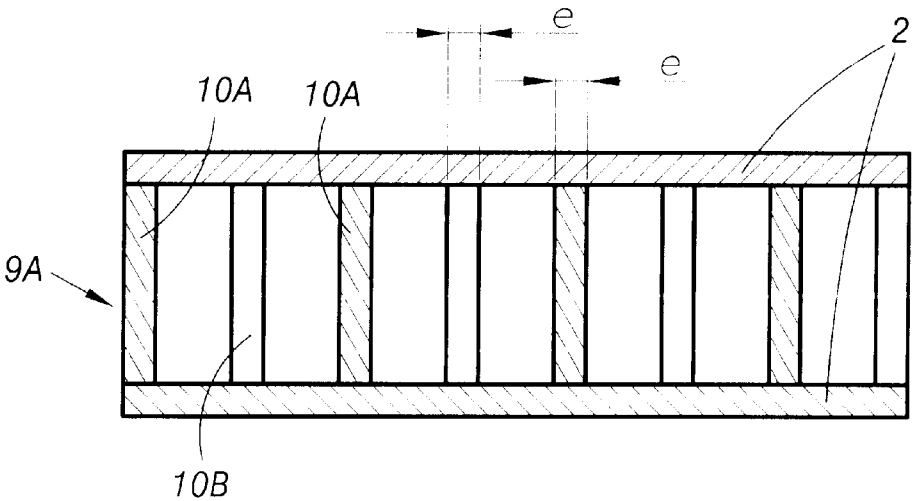
Figure 9:
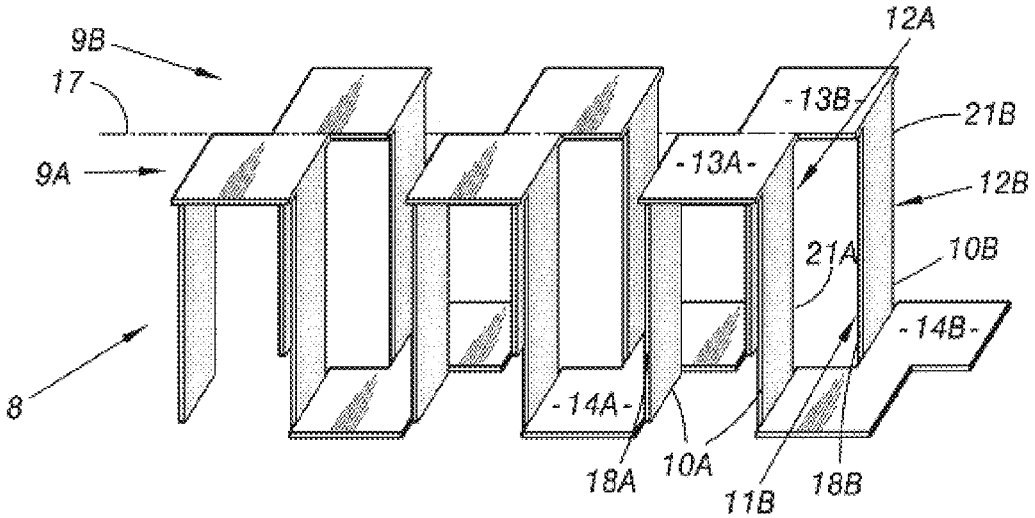
Figure 10:
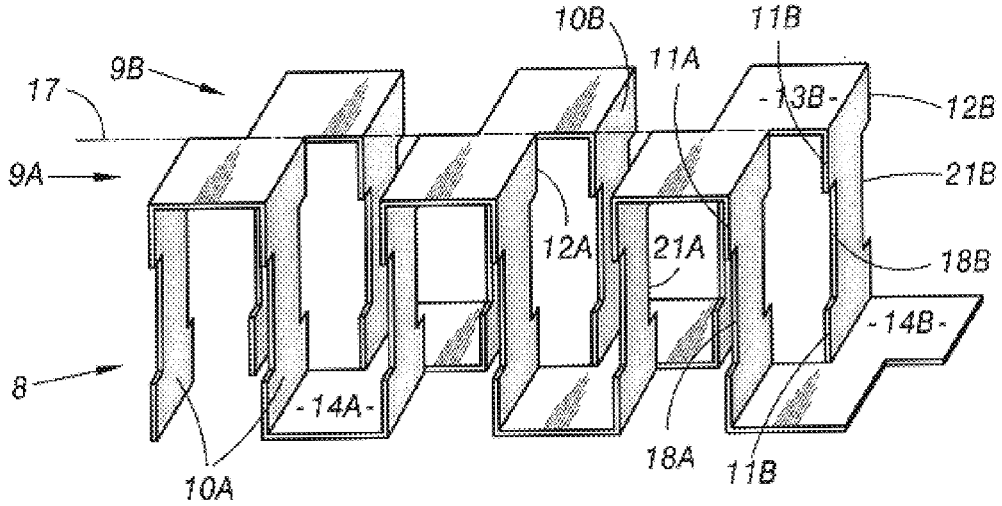
Figure 11:
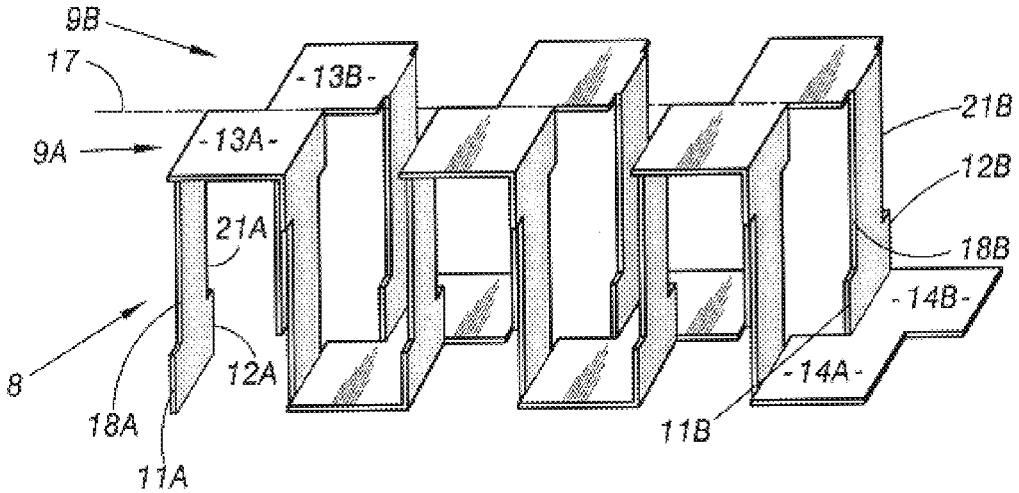
Figure 15:
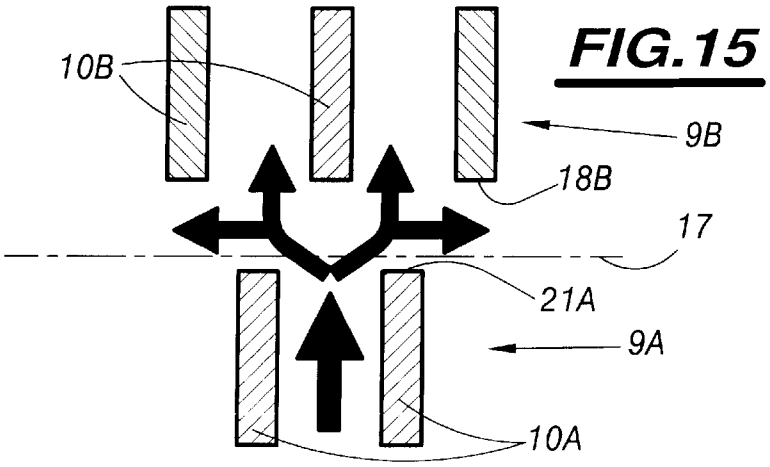
Figure 14:
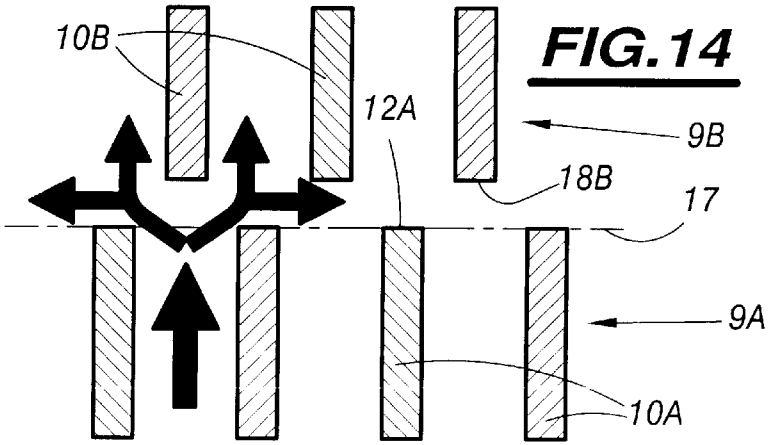
FIG. 14 is a view similar to FIG. 5 but relating to a corrugated fin like those of FIGS. 6, 7 and 8.
Figure 17:
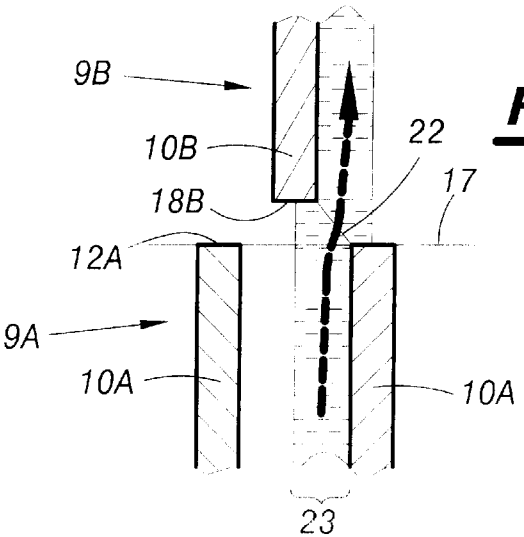
Figure 16:
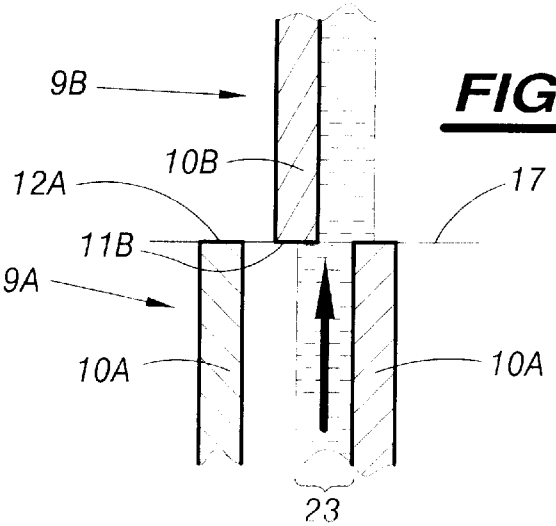

FIG. 15 is a view similar to FIG. 14 but relating to a corrugated fin like those of FIGS. 9, 10 and 11; and FIGS. 16 and 17 are details of FIGS. 5 and 14 respectively, illustrating one property of the corrugated fins according to the invention.

Figure 6:
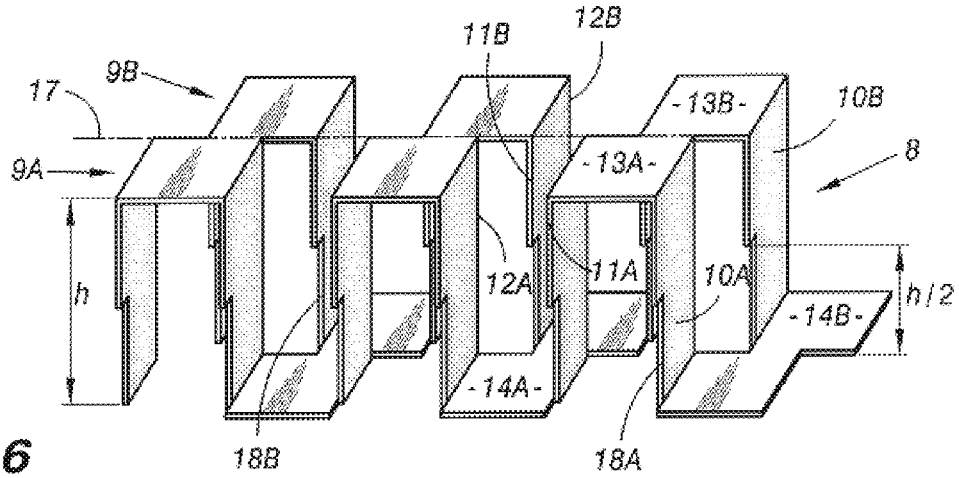
FIG. 6 depicts, in perspective, a corrugated fin according to the invention.

In the embodiment of FIG. 6, each leg 10 comprises a notch 18 on its single leading edge 11. This notch 18 extends from the trough 14 to mid-height, that is to say to the level h/2.

In each of FIGS. 6 to 13, two rows of corrugations 9A and 9B have been depicted in perspective. The corrugation elements have been given suffixes A and B according to the row to which they belong.

Figure 7:
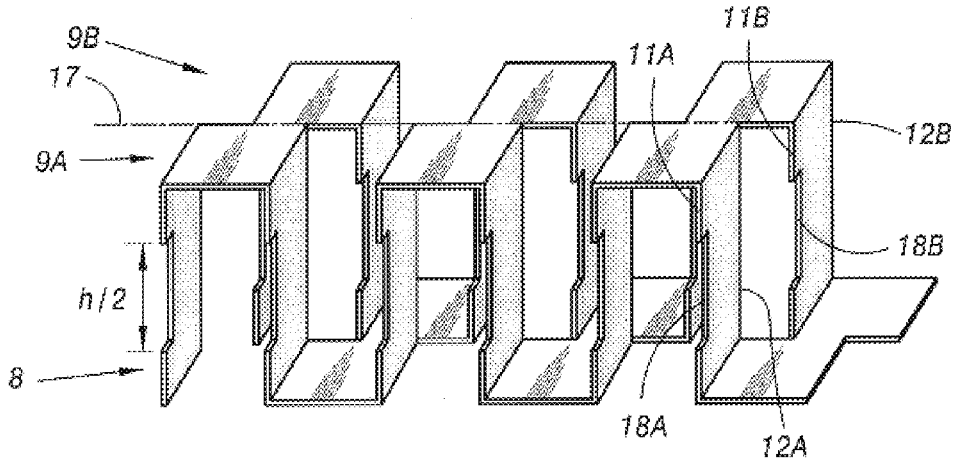
FIGS. 7 to 13 are views similar to FIG. 6 but corresponding to various other embodiments of the corrugated fin according to the invention.

The embodiment of FIG. 7 differs from that of FIG. 6 only in that the notches 18, which again have the length h/2, are mid-way along the leading edges 11 of the legs 10.

Figure 8:
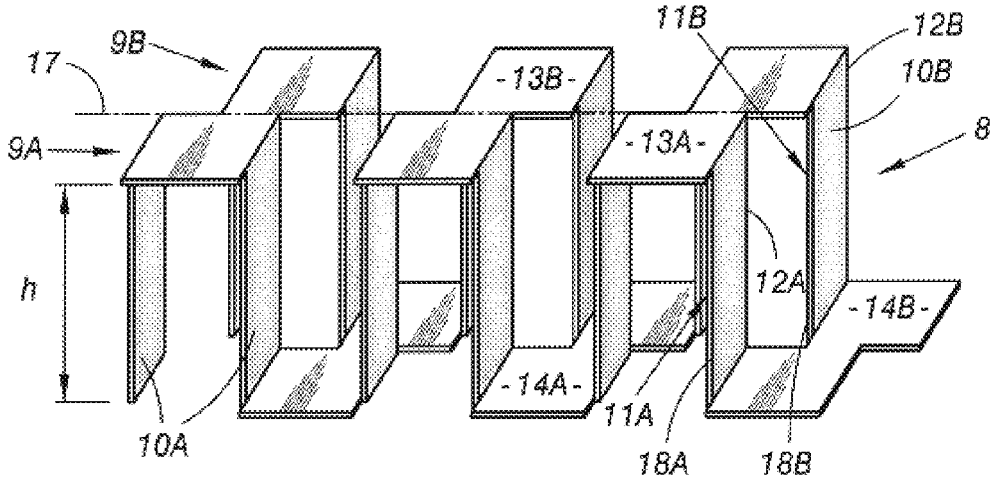

The embodiment of FIG. 8 differs from the preceding embodiments only in that the notches 18 have the length h and extend over the entire height of the leading edges 11, without, however, affecting the crests 13 and the troughs 14.

The embodiment of FIG. 9 differs from the previous one only in that the legs 10 also have a notch 21 over the entire height of the height of their trailing edge 12, these notches 21 not affecting the crests 13 and the troughs 14 either.

The corrugated fin of FIG. 10 differs from that of FIG. 7 only in the addition of a notch 21 of length h/2 mid-way along the trailing edge 12 of each leg. As an alternative, the notches 18 and 21 may have a length other than h/2, and less than h.

In the embodiment of the corrugated fin of FIG. 11, each leg 10 has a notch 18 on its leading edge and a notch 21 on its trailing edge; these two notches have the same height which is between h/2 and h, and the same vertical position, but the notches are offset vertically from one leg to the other. Thus, on one row 9A or 9B, from one leg to the next, the notches 18 and 21 are alternately adjacent to the crest of the corrugation 13 and to the trough 14.

Figure 12:
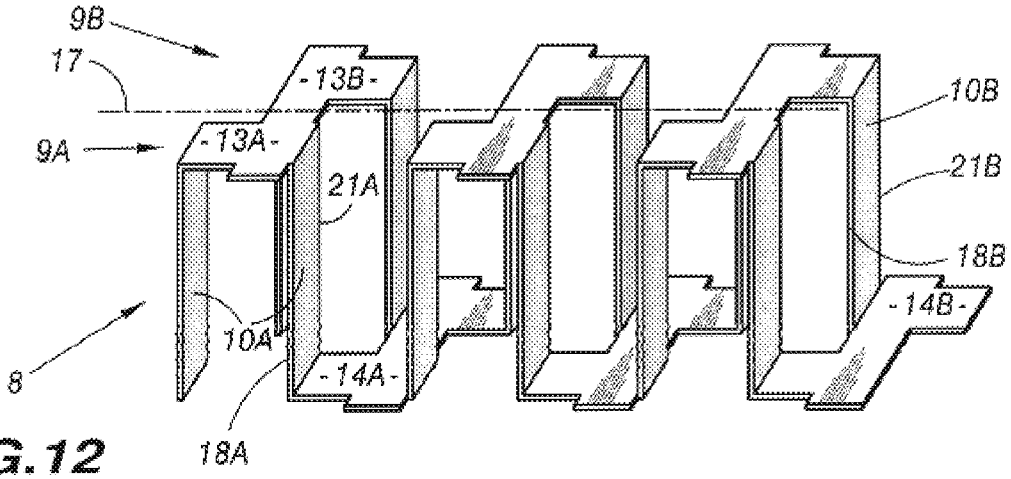

The embodiment of FIG. 12 differs from that of FIG. 9 only in that the notches 18 and 21 continue alternately into the crests 13 and into the troughs 14, weakening these. This weakening may be disadvantageous in the case of fluids conveyed under pressure, because it reduces the area of fin brazed to the adjacent plates of the exchanger.

Figure 13:
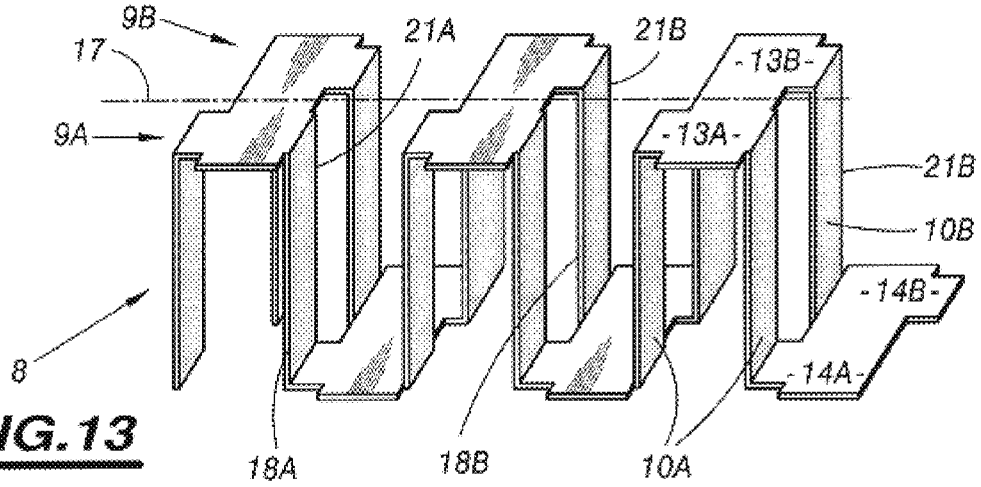

This is why it may be preferable, in certain applications, as depicted in FIG. 13, in this variant to adopt an offset less than p/2 from one row 9 to the next. This thus yields an advantage of greater mechanical strength but, on the other hand, gives rise to a loss of thermal efficiency.

As illustrated in FIGS. 14 and 15, in all the variant embodiments of the fin 8 described above, the notches 18 or 18 and 21 (or 21) encourage two-dimensional flow of the fluid in the region of the offsetting lines 17. Accordingly, the streams of fluid coming from the various channels in the fin are partially remixed. The efficiency of the heat exchange is thus improved.

When there is also a vertical offset between the notches 18 and 21, as in the case of FIG. 11, a three-dimensional effect is introduced into the flow of the fluid, and this encourages heat exchange even more.

A comparison between FIGS. 16 and 17, which respectively illustrate the flow of a stream of fluid through a conventional serrated corrugation (FIG. 16) and through a serrated corrugation according to the invention (FIG. 17) shows that the pressure drop by restriction at the passage of an offsetting line 17 is greatly reduced if the passage cross section 22 defined by the notch 18 (or by the notch 21 if only the trailing edge is notched, or by the notches 18 and 21 facing each other) is at least equal to half the passage cross section 23 of each channel defined between two legs 10. In effect, the throttling upon crossing the line 17 is then eliminated.

The fins described hereinabove can be made of various materials commonly used in plate-type heat exchangers: aluminium and aluminium alloys, copper and copper alloys, stainless steels and titanium.

What is claimed is:

1. Corrugated fin with partial offset for a plate-type heat exchanger, of the type defining a main overall direction of corrugation and comprising a number of adjacent rows of corrugations, each row being more or less transverse with respect to the said main overall direction and being offset, in its own longitudinal direction, with respect to the two adjacent rows, each row of corrugations comprising a set of corrugation legs connected alternately by a corrugation crest and a corrugation trough, characterized in that at least some corrugation legs have a notch on at least one edge and over at least part of their height.

2. Corrugated fin according to claim 1, characterized in that the depth of the notch is chosen so as to provide a stream of fluid flowing in a direction close to the said main overall direction with a passage cross section that is at least approximately constant, or increased, in the notched region of each leg.

3. Corrugated fin according to claim 1 or 2, characterized in that the notch is on the leading edge.

4. Corrugated fin according to any one of claims 1 to 3, characterized in that the notch is on the trailing edge.

5. Corrugated fin according to any one of claims 1 to 4, characterized in that some notches are offset with respect to the others at right angles to the overall plane of the fin.

6. Corrugated fin according to claim 5, characterized in that the notches are offset at right angles to the overall plane of the fin from one corrugation leg to the next on one and the same row.

7. Corrugated fin according to any one of claims 1 to 6, characterized in that the notch extends over the entire height of the corrugation leg.

8. Corrugated fin according to any one of claims 1 to 7, characterized in that the notch continues onto the adjacent corrugation crest and/or onto the adjacent corrugation trough.

9. Corrugated fin according to any one of claims 1 to 8, characterized in that the offset from one row to the next is less than half the pitch of the corrugations.

10. Plate-type heat exchanger of the type comprising a stack of parallel plates which define a number of passages of flat overall shape for the circulation of fluids, closure bars which delimit these passages, and corrugated fins arranged in the passages, characterized in that at least some of the corrugated fins are according to any one of claims 1 to 9.

* * * * *